US007000582B2

(12) United States Patent
Takeo et al.

(10) Patent No.: US 7,000,582 B2
(45) Date of Patent: Feb. 21, 2006

(54) ROCKER ARM

(75) Inventors: Noriyuki Takeo, Kanagawa (JP); Kazushige Gotou, Kanagawa (JP); Satoshi Kadokawa, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/490,848

(22) PCT Filed: Oct. 3, 2002

(86) PCT No.: PCT/JP02/10328

§ 371 (c)(1),
(2), (4) Date: Oct. 5, 2004

(87) PCT Pub. No.: WO03/031777

PCT Pub. Date: Apr. 17, 2003

(65) Prior Publication Data

US 2005/0034696 A1 Feb. 17, 2005

(30) Foreign Application Priority Data

Oct. 5, 2001 (JP) ..... 2001-309940
Oct. 29, 2001 (JP) ..... 2001-330161

(51) Int. Cl.
*F01L 1/18* (2006.01)

(52) U.S. Cl. ..... 123/90.39; 123/90.44; 123/90.16

(58) Field of Classification Search ..... 123/90.39, 123/90.41, 90.44; 29/888.2; 74/559, 569
See application file for complete search history.

(56) References Cited

U.S. PATENT DOCUMENTS 5,016,582 A * 5/1991 Mills ..... 123/90.39
6,199,527 B1 * 3/2001 Okubo et al. ..... 123/90.41
2001/0000572 A1 5/2001 Okubo

FOREIGN PATENT DOCUMENTS

JP 60-128023 U 8/1985
JP 8-210006 A 8/1996
JP 2000-240409 A 9/2000
JP 2000-240410 A 9/2000

* cited by examiner

*Primary Examiner*—Thomas Denion
*Assistant Examiner*—Ching Chang
(74) *Attorney, Agent, or Firm*—Miles & Stockbridge PC

(57) ABSTRACT

The rocker arm 1 has a fitting surface 6 on the opposite sides of which guide surfaces 21 are formed, such that the guide surfaces 21 are inclined to be closer to each other toward their tip ends. Even when the valve stem 20 is displaced in the widthwise direction of the fitting surface 6, the outer peripheral surface of the base end portion of the valve stem 20 comes into contact with only the tip end of one of the guide surfaces 21. Consequently, lubrication is improved and friction moment is decreased in the contact area, so that friction resistance is suppressed between the guide surfaces 21 and the outer peripheral surface of the base end of the valve stem 20 to easily obtain high performance of the engine.

8 Claims, 12 Drawing Sheets

ROCKER ARM

TECHNICAL FIELD OF THE INVENTION

This invention relates to improvements for converting the rotation of the camshaft assembled in the valve gear of an engine to reciprocating motion of a valve stem (air intake valve and exhaust valve).

BACKGROUND OF THE INVENTION

In a reciprocating engine (reciprocating-piston engine), except for some 2-cycle engines, there are air-intake valves and exhaust valves that open and close in synchronization with the rotation of the crankshaft. In this kind of reciprocating engine, the movement of the camshaft that rotates in synchronization with the rotation of the crankshaft (½ the rpm in the case of a 4-cycle engine) is transmitted to the air-intake valves and exhaust valves by rocker arms, and causes the air-intake valves and exhaust valves to move in a reciprocating motion in the axial direction.

Conventionally, castings (cast iron parts or aluminum die-cast parts) were used for the rocker arm assembled in the valve gear of this kind of engine. However, in recent years, manufacturing the rocker arms by pressing metal plate such as steel plate has been considered, and is being performed somewhat. The reason for this is that castings are heavy (in the case of cast iron parts) or that a lot of volume is required for securing sufficient strength (in the case of aluminum die cast parts), and that since they are typically manufactured using a lost-wax process, the manufacturing cost is high.

Prior art technology related to a metal plate rocker arm that takes this into consideration has been disclosed in Japanese patent publication No. Tokukai 2000-120411. FIGS. 4 to 10 show the invention related to the rocker arm and manufacturing method described in that disclosure. As shown in FIG. 4, this prior art rocker arm 1 comprises a pair of side-wall sections 2 that are nearly parallel with each other, a connecting section 3 and second connecting section 4 that connect the edges on one end in the width direction of these side wall sections 2 to each other, respectively. Also, a pair of circular holes 5 are formed in the middle section in the lengthwise direction of both of side wall sections 2 such that they are concentric with each other, and both of these circular holes 5 support both ends of a support shaft that supports the roller in engagement with the cam such that the roller rotates freely. Of the connecting section 3 and second connecting section 4, a fitting surface 6 that comes in contact with the base end of the valve stem is formed on one surface of the connecting section 3, and a fitting section 7 that comes in contact with the tip end of the lash adjuster is formed on the second connecting section 4. It is not shown in the figures, however, construction of forming a screw hole in the second connecting section and screwing an adjuster screw into that screw hole is also disclosed in Japanese patent publication No. Tokukai 2001-59407 and is well known in the art.

Of the fitting surfaces 6 and 7, fitting surface 6 is formed in the middle section in the width direction of the connecting section 3 on its one surface by causing this middle section in the width direction of the connecting section 3 to deform plastically in the direction of thickness such that it has a concave groove shape which is depressed more than the other sections of the connecting section 3. Also, there is a protruding section 8 having a trapezoid shaped cross section formed on the other surface of this connecting section 3 such that it protrudes in an embankment shape when the fitting surface 6 is formed. On the other hand, the fitting surface 7 is formed by plastically deforming the center section of the second connecting section 4 in the direction of thickness such that it is a spherical concave surface. In the case of construction using an adjuster screw, the tip end of the adjuster screw is formed in a spherical convex surface shape.

When manufacturing this kind of rocker arm 1, first, in a first process, a first blank plate 9 as shown in FIG. 5 is made. In other words, in this first process, a sufficiently rigid metal plate (flat plate or coil plate) such as carbon steel plate having a thickness of, for example, 3 mm to 4 mm is supplied between the punching die and receiving die of the press apparatus (not shown in the figure), and the first blank plate 9 is punched and formed between these dies.

As shown in FIG. 5(A), this first blank plate 9 has a diamond-like shape with rounded corners and with on one end in the lengthwise direction {right end in FIG. 5(A)} cut out, and has a thickness $t_9$ {FIG. 5(B)}. The section having width $W_{10}$ that is located in the center section in the width direction {up-down direction in FIG. 5(A)} of this first blank plate 9, that is in the section located further inward than the two dashed lines $\alpha$ in FIG. 5(A) (section in and near the center in the width direction) is the base section 10 that extends in the lengthwise direction {left-right direction in FIG. 5(A)} of this first blank plate 9. Also, on both sides in the width direction of this base section 10, there is a pair of triangular-shaped fin sections 11.

Next, as shown in FIG. 6(A), in a second process, a through hole 12 is formed in the center section of this first blank plate 9, to form a second blank plate 13. This through hole 12 has a large hand-drum shape, and there is a pair of partially arc-shaped tab sections 14 formed on both sides in the width direction of the through hole 12 and in the center section in the lengthwise direction of the blank plate 13 such that they protrude in a direction toward each other. Both of these tab sections 14 are formed in order to form the circular holes 5 (see FIG. 4 and FIG. 10) for supporting the ends of the support shaft, so that the roller supported (described later) rotates freely. Also, semi-circular notch sections 15 are formed in the four corners of the through hole 12. These notch sections 15 are formed in order that in the third process, when forming a curved section 16 (see FIG. 7) by bending the base section 10 such that it has a substantially arc-shaped cross section, the bending work can be performed more easily.

This second blank plate 13 is formed by supplying the first blank plate 9 between a punching die and receiving die that are assembled in the pressing apparatus (not shown in the figures), and punching out the aforementioned through hole 12 between these dies. The width $W_{10}$ of the base section 10 of the first blank plate 9 and second blank plate 13 is greater than the space between the outside surfaces of the pair of side-wall sections 2 that are formed in the third process (described next), that is the width $W_{17}$ of a first intermediate member 17 (see FIG. 7) ($W_{10}>W_{17}$). As the width $W_{10}$ of the base section 10 is made greater than the width $W_{17}$ of the first intermediate member 17 in this way, the space $D_{14}$ between the pair of tab sections 14 is increased, and thus it is possible to maintain the life of the punching die used for punching the through hole 12. It is also possible to change the order for making the second blank plate 13 from what was described above.

The second blank plate 13 that is formed into the shape shown in FIG. 6 becomes the first intermediate member 17 in the third process as shown in FIG. 7. In this third process, the second blank plate 13 is supplied and strongly pressed between the pressure die and receiving die of the pressing apparatus (not shown in the figures) to bend the base section 10 of this second blank plate 13 and the fin sections 11, 11. Also, this second blank plate 13 becomes the first intermediate member 17 having a pair of side-wall sections 2, 2 on the left and right in the width direction, and curved sections 16 that connect the opposite end edges in the width direction {left and right direction in FIGS. 7(C) and 7(D)} of these side-wall sections 2, respectively. The curved sections 16 are formed into a semi-cylindrical shape such that they are non-continuous in the middle in the lengthwise direction {left and right direction in FIG. 7(A)} of the first intermediate member 17 that corresponds to the through hole 12. One of the curved sections 16 divided in two by the through hole 12 in this way, is provided on one end side {right end side in FIGS. 7(A) and 7(B)} and becomes the connecting section 3 (see FIGS. 4, 9 and 10) which comprises the fitting surface 6 coming in contact with the base section of the valve, and the other is provided on the other end side {left end side in FIGS. 7(A) and 7(B)} and becomes the second connecting section 4 (see FIGS. 4, 9 and 10) which comprises the fitting surface 7 coming in contact with the tip end of the lash adjuster. Also, in the case of construction that uses an adjuster screw, a screw hole is formed in this second connecting section 4.

As described above, the width $W_{17}$ of the first intermediate member, which is the space between the outside surfaces of the pair of side wall sections 2, is less than the width $W_{10}$ of the base section 10 of the first and second blank plates 9 and 13. In other words, in the first intermediate member 17, the curved sections 16, which play the role of a connecting section for connecting the end edges in the width direction of the pair of side wall sections 2, is formed into a substantially semi-cylindrical shape as shown in FIGS. 7(C) and 7(D). The curved sections 16 are formed into a semi-cylindrical shape in this way such that the width of the curved sections 16 is less than the width $W_{10}$ of the base section 10 of the flat plate, which is the origin of the curved sections 16, so it is possible to make the width $W_{10}$ of this base section 10 greater than the width $W_{17}$ of the first intermediate member 17, which is the space between the outside surfaces of the left and right side wall sections 2 formed on the first intermediate member 17 ($W_{10}>W_{17}$), and thus it is possible to increase the space $D_{14}$ between the aforementioned tab sections 14. The thickness $t_{16}$ of the curved sections 16 of the first intermediate member 17 that was obtained from the third process described above and as shown in FIG. 7, is nearly the same as the thickness $t_9$ of the first blank plate 9 ($t_{16}\approx t_9$).

Pressing is performed in a fourth process, which will be described next, on at least an end side portion of the curved section 16 to increase the thickness, such that the end side portion becomes the fitting surface 6 that comes in contact with the base section of the valve stem. In this case, in order to obtain the desired thickness after the pressing process, it is necessary to regulate the shape and dimensions of the curved sections 16. In other words, the selection of shape and dimension on the curved sections 16 determines the thickness in the pressing process. Moreover, when forming the curved sections 16, the pair of side-wall sections 2 are formed at the same time in the intermediate blank 17. In other words, the fin sections 11 that are formed on both ends in the width direction of the first and second bland plates 9 and 13, and the tab sections 14 that are formed on the inside edge of the through hole 12 in the center section are stood up to form the pair of nearly parallel side-wall sections 2 as the curved sections 16 are formed.

In the fourth process, pressing is performed on the curved sections 16 of the first intermediate member 17 that was constructed as described above to form the second intermediate member 18 as shown in FIG. 8. In other words, in the fourth process, the curved sections 16 are pressed into a flat plate and the thickness is increased, and as shown in FIG. 8, the connecting section 3 and second connecting section 4 are made to have thickness $t_3$ and $t_4$ that are greater than the thickness $t_9$ of the first blank plate {see FIG. 5(B)} ($t_9<t_3, t_4$).

In the fourth process, the curved sections 16 of the first intermediate section 17 are set between the pressing die and the receiving die, and pressure is applied by cold forging to plastically deform the curved sections 16. As a result, a flat connecting section 3 and second connecting section 4 are formed. In this way, when plastically deforming the curved sections 16 to form the connecting section 3 and second connecting section 4, the thickness is increased to $t_3$ and $t_4$ in the curved sections 16 with arc-shaped cross section as they become the flat connecting section 3 and second connecting section 4, respectively. The process of transforming the curved sections 16 having an arc shaped cross section into the flat connecting section 3 and second connecting section 4, respectively, while at the same time increasing the thickness, can be performed easily using a pressing process that uses a press.

In the example shown in the figures, not only is the thickness of the connecting section 3 formed on the side of one end increased, but the thickness of the second connecting section 4 that is formed on the side of the other end is also increased. However, it is on the side of the connecting section 3, where the fitting surface 6 is formed to come in contact with the base section of the valve stem, that large stress is particularly applied when using the rocker arm. Therefore, it is not absolutely necessary to increase the thickness on the side of the second connecting section 4. If it is not necessary to increase the thickness, it is possible to simply plastically deform that curved section 16 to form the flat connecting sections. However, when the thickness of the connecting section 3 and second connecting section 4 are the same, it is possible to reduce the amount of processing and to be more cost effective.

In the fourth process, if the second intermediate member 18 is formed from the first intermediate member 17 by forming a relatively thick connecting section 3 and second connecting section 4, then next, in the fifth process, plastic deformation or cutting and grinding is performed on the connecting section 3 and second connecting section 4. In other words, as shown in FIG. 9, the fitting surface 6 that comes in contact with the base section of the valve stem (not shown in the figure) is formed on the connecting section 3. Also, the fitting section 7 that comes in contact with the tip end of the lash adjuster (not shown in the figure) is formed on the second connecting section 4. In this fifth process, the connecting section 3 of the second intermediate member 18 is set between the pressing die and receiving die of the forging machine (not shown in the figure), and by performing cold forging on the connecting section 3, a fitting surface 6 is formed having a concave groove shape as shown in FIGS. 9(A), 9(B) and 9(D) where the bottom surface is curved in a convex shape. Also, the second connecting section 4 is set between the pressing die and receiving die of a different forging machine (not shown in the figure), and by performing cold forging on this second connecting section 4, a spherical concave fitting section 7 as shown in FIGS. 9(A), 9(B) an 9(C) is formed. Formed in this fifth process is a third intermediate member 19 which is formed with a fitting surface 6 and fitting section 7 on the connecting section 3 and second connecting section 4 that are thicker than the first blank plate 9.

Next, in a sixth process, circular holes 5 are formed in the third intermediate member 19, that was obtained as described above, in the middle section of the pair of side-wall sections 2 using a press or a cutting process such that they are aligned with each other, to complete the rocker arm 1 as shown in FIG. 4 and FIG. 10. These circular holes 5 are for supporting both of the ends of the support shaft (not shown in the figures) that supports the roller (also not shown in the figures) such that it can rotate freely. In other words, when installed in the engine, a roller is supported around the middle section of the support shaft whose ends are supported in the circular holes 5 such that it can rotate freely, and the outer peripheral surface around this roller comes in contact with the outer peripheral surface around the cam that is fixed to the camshaft. Also, the base end face of the valve stem 20, which is the air-intake valve and exhaust valve, comes in contact with the fitting surface 6 (see FIGS. 1 to 3, 11 and 13 to 18 showing an embodiment of the present invention), and the tip end face of the lash adjuster (not shown in the figures) comes in contact with the fitting section 7. The tip end face of this lash adjuster is a semi-spherical convex surface, and this surface on the tip end fits with the fitting section 7 such that it can rock and move freely. With this kind of construction, the rotation of the camshaft is freely converted to rocking motion of the rocker arm 1. Also, in the case of construction using an adjuster screw, the spherical convex surface formed on the tip end of this adjuster screw comes in contact with the bearing surface, so that the rocker arm rocks freely around this point of contact.

A pair of guide surfaces 21 is formed on both sides in the width direction of one surface of the connecting section 3 of the rocker arm 1 such that they are located on both sides in the width direction of the fitting surface 6. More specifically, these guide surfaces 21 are formed on wall sections that continue on from the side-wall sections 2. Also, the base end section of the valve stem 20 that comes in contact with the fitting surface 6 is prevented from becoming separated from the fitting surface 6 in the width direction by this pair of guide-wall sections 21. Moreover, in the case of the prior art technology shown in FIG. 4 to 10, these guide surfaces 21 are flat parallel surfaces.

The rocker arm and manufacturing method described above not only make it possible to improve the strength and rigidity of the rocker arm, but by reducing the number of manufacturing process and the number of parts, it is possible to reduce costs, improve precision and simplify the equipment, and thus it is possible to manufacture a high quality rocker arm at low cost.

Incidentally, it is sometimes preferred to change the width of the rocker arm according to the parts that fit in the rocker arm, or in other words according to the width and diameter of the roller 30 (see FIGS. 19 and 20 described later), the lash adjuster and also the valve stem 20. Since the widths and diameters of the roller 30, lash adjuster and valve stem 20 are all different, it is sometimes preferred to change the width of the rocker arm to correspond with the width and diameter of these parts in order to make a good fit between these parts, the lash adjuster and the rocker arm. A rocker arm 1 as shown in FIGS. 19 and 20 and disclosed in Japanese patent publication No. Tokukai Hei 7-229407 is manufactured taking this point into consideration.

In the case of the rocker arm 1 shown in FIGS. 19 and 20, the side wall sections 2 is crooked, so that the width of the connecting section 3 that comes in contact with the base end section of the valve stem 20 is narrow, and that the width of the second connecting section 4 that comes in contact with the tip end section of the lash adjuster is wide. The space where the roller 30 is supported in the middle section between the side wall sections 2 is sized between the space for the connecting section 3 and the space for the second connecting section 4.

In the case of the prior art construction described above, the pair of guide surfaces 21 that are formed on both sides in the width direction of the fitting surface 6, are flat and parallel surfaces, so when the base end section of the valve stem 20 (see FIGS. 1 to 3) moves to a side in the width direction of the fitting surface 6 such that the outer peripheral surface of the valve stem 20 comes in contact with anyone of the guide surfaces 21, the contact area is broader (the length of the contact area is longer in the axial direction of the valve stem 20). As a result, the friction force acting on the point of contact between the outer peripheral surface of the valve stem 20 and that guide surface 21 is large, and as the rocker arm 1 rocks, the friction loss is large. This kind of increase in friction loss, is not desirable since it hinders improvement of performance such as engine fuel efficiency and power efficiency.

Also, as shown in FIGS. 19 and 20, in the case where the middle section of the left and right side-wall sections 2 are bent in order that the width of the connecting section 3 that comes in contact with the base end section of the valve stem 20 becomes narrow, a large tensile stress is applied to part of the metal plate of the rocker arm 1 in the bent sections 24 of these side-wall sections 2. As a result, it becomes easy for damage such as cracking to occur in and near the bent sections 24, and it becomes difficult to maintain the reliability and durability of the rocker arm 1.

DISCLOSURE OF THE INVENTION

Taking the above problems into consideration, an object of this invention is to keep the friction force acting on the point of contact between the outer peripheral surface of the valve and the guide surfaces small.

The rocker arm according to a first feature of the invention comprises a pair of side-wall sections that are separated by a space from each other, and a connecting section that connects these side-wall sections to each other at one end edge in the width direction of them. Also at least one pair of circular holes are formed on the side-wall sections such that they are aligned with each other, and a fitting surface is formed on one surface of the connecting section to come in contact with the end face of the valve stem, and a pair of guide surfaces are formed to prevent the valve stem from moving to either of the sides in the width direction of the fitting surface. Moreover, by making these guide surfaces unparallel such that the space between the guide surfaces on the side away from the fitting surface along the center axis of the valve stem is more narrow than the space on the side near the fitting surface, the friction area between the guide surfaces and the valve stem is kept small.

In the case of the rocker arm according to this first feature of the invention, when the base end section of the valve stem moves in the width direction of the fitting surface, so that the outer peripheral surface of this base end section comes in contact with on either of the guide surfaces, the area of the point of contact between these surfaces becomes narrow, or in other words, the length of the point of contact in the axial direction of the valve stem becomes short. Therefore, even when both the valve stem and rocker arm rock and move relative to each other, it is possible to keep the friction force acting on the point of contact between these surfaces small. In other words, since the length of the point of contact in the axial direction of the valve stem is short, it is possible to improve the lubricity of the point of contact and keep the friction force per unit area small, as well as it is possible to keep small the moment of the friction resistance that acts at this point of contact. As a result, it becomes easier to keep small the resistance that occurs at the fitting section between the rocker arm and the valve stem and to improve the performance of the engine.

The rocker arm according to a second feature of the invention comprises a pair of side-wall sections that are made by plastically processing a metal plate such that they are separated from each other by a space, and a connecting section that connects these side-wall sections to each other on one end edge in the width direction thereof. Also, one surface of this connecting section is made to be a fitting surface that comes in contact with the end face of the valve stem, and guide-wall surfaces are formed on both sides of this fitting surface for preventing the valve stem from moving to either side in the width direction. Moreover, the outside surfaces of these guide-wall sections and the outside surfaces of the side-wall sections are continued to each other such that they are located on a single flat surface, and the thickness of the parts of the guide-wall sections that are located on both sides of the valve stem that comes in contact with the connecting section is made different from the thickness of the other parts, so that the space between the guide-wall sections in this part corresponds to the outer diameter of the valve stem.

In the case of the rocker arm according to this second feature of the invention, there is no tensile stress in or near the side-wall sections or guide-wall sections, and the space between the pair of guide-wall sections that are located on both sides of the connecting section that comes in contact with the base end section of the valve stem can be changed to correspond to the diameter of the base end section of the valve stem. Therefore, it is possible to make the fitting with the base end section of the valve stem more suitable, and to make a rocker arm that has excellent reliability and durability.

BRIEF DESCRIPTION OF THE DRAWINGS

FIG. 5(A) to FIG. 5(D) are a view to show a first blank obtained through a first step of a conventional production method for rocker arm, wherein FIG. 5(A) is a top plan view, FIG. 5(B) is a cross section taken along the line Vb—Vb in FIG. 5(A), FIG. 5(C) is a cross section taken along the line Vc—Vc in FIG. 5(A) and FIG. 5(D) is a cross section taken along the line Vd—Vd in FIG. 5(A).

FIG. 6(A) to FIG. 6(D) are a view to show a second blank obtained through a second step of the conventional production method for rocker arm, wherein FIG. 6(A) is a top plan view, FIG. 6(B) is a cross section taken along the line VIb—VIb in FIG. 6(A), FIG. 6(C) is a cross section taken along the line VIc—VIc in FIG. 6(A) and FIG. 6(D) is a cross section along the line VId—VId in FIG. 6(A).

FIG. 7(A) to FIG. 7(D) are a view to show intermediate blank obtained through a third step of the conventional production method for rocker arm, wherein FIG. 7(A) is a top plan view, FIG. 7(B) is a cross section taken along the line VIIb—VIIb in FIG. 7(A), FIG. 7(C) is a cross section taken along the line VIIc—VIIc in FIG. 7(A) and FIG. 7(D) is a cross section along the line VIId—VIId in FIG. 7(A).

FIG. 8(A) to FIG. 8(D) are a view to show a second intermediate blank obtained through a fourth step of the conventional production method for rocker arm, wherein FIG. 8(A) is a top plan view, FIG. 8(B) is a cross section taken along the line VIIIb—VIIIb in FIG. 8(A), FIG. 8(C) is a cross section taken along the line VIIIc—VIIIc in FIG. 8(A) and FIG. 8(D) is a cross section along the line VdIII—VIIId in FIG. 8(A).

FIG. 9(A) to FIG. 9(D) are a view to show a third intermediate blank obtained through a fifth step of the conventional production method for rocker arm, wherein FIG. 9(A) is a top plan view, FIG. 9(B) is a cross section taken along the line IXb—IXb in FIG. 9(A), FIG. 9(C) is a cross section taken along the line IXc—IXc in FIG. 9(A) and FIG. 9(D) is a cross section along the line IXd—IXd in FIG. 9(A).

FIG. 10(A) to FIG. 10(D) are a view to show a rocker arm completed through a sixth step of the conventional production method for rocker arm, wherein FIG. 10(A) is a top plan view, FIG. 10(B) is a cross section taken along the line Xb—Xb in FIG. 10(A), FIG. 10(C) is a cross section taken along the line Xc—Xc in FIG. 10(A) and FIG. 10(D) is a cross section along the line Xd—Xd in FIG. 10(A).

DESCRIPTION OF THE PREFERRED EMBODIMENT

The rocker arm of this invention, similar to the conventionally known rocker arm described above, is made by performing plastic working of a metal plate, and comprises a pair of side-wall sections that are separated from each other by a space, and a connecting section that connects the edges on one end in the width direction of these side-wall sections to each other. Also, at least one pair of circular holes are formed in these side-wall sections such that they are aligned with each other, and one surface of the connecting section is made to be a fitting surface for coming in contact with the end face of the valve stem, and a pair of guide surfaces, and more specifically, a pair of guide-wall sections are formed on the opposite sides of the fitting surface to prevent the valve stem from moving to either side in the width direction.

Figure 4:
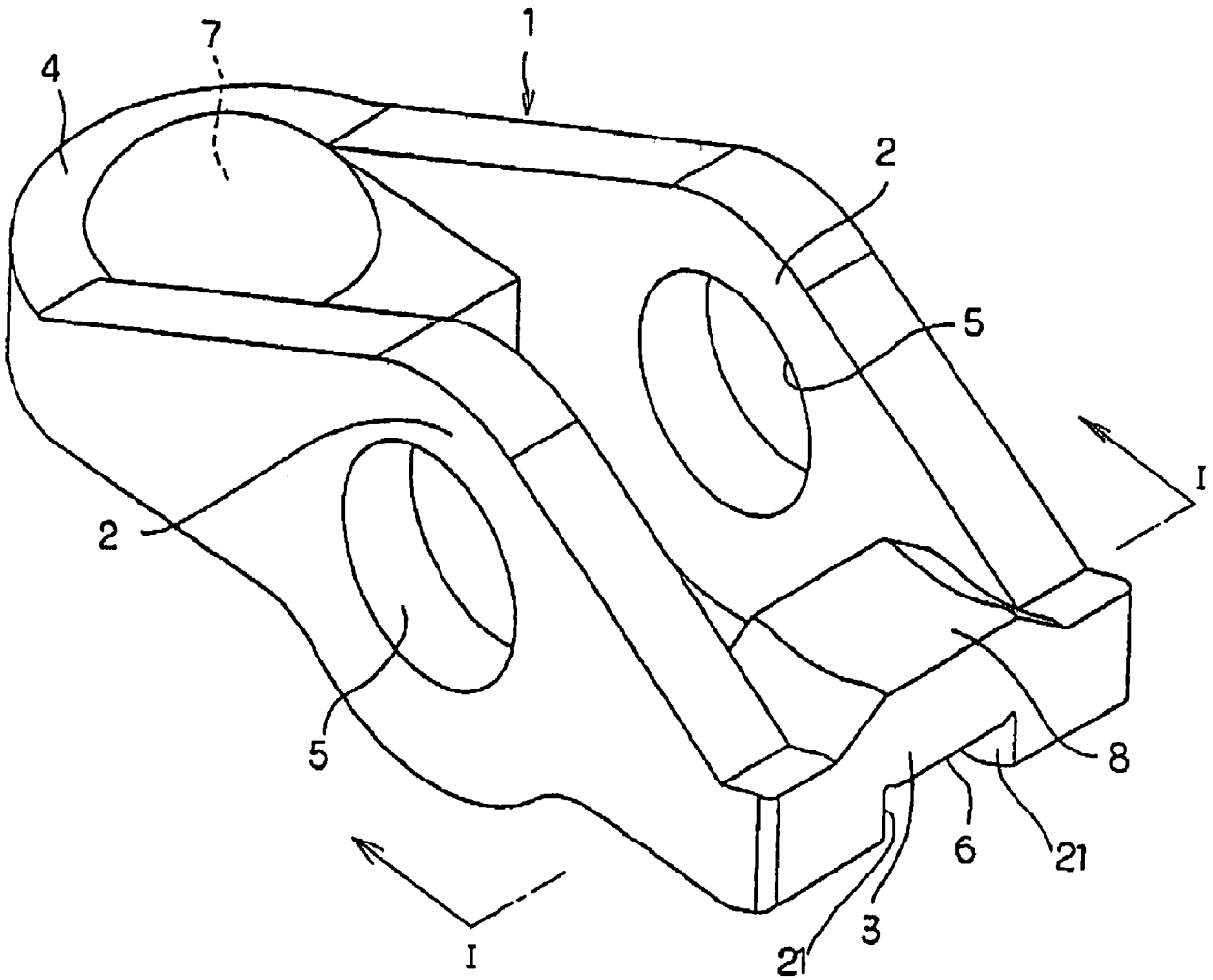
Prior Art Fig. 4
FIG. 4 is a perspective view of a conventional rocker arm.
Figure 5:
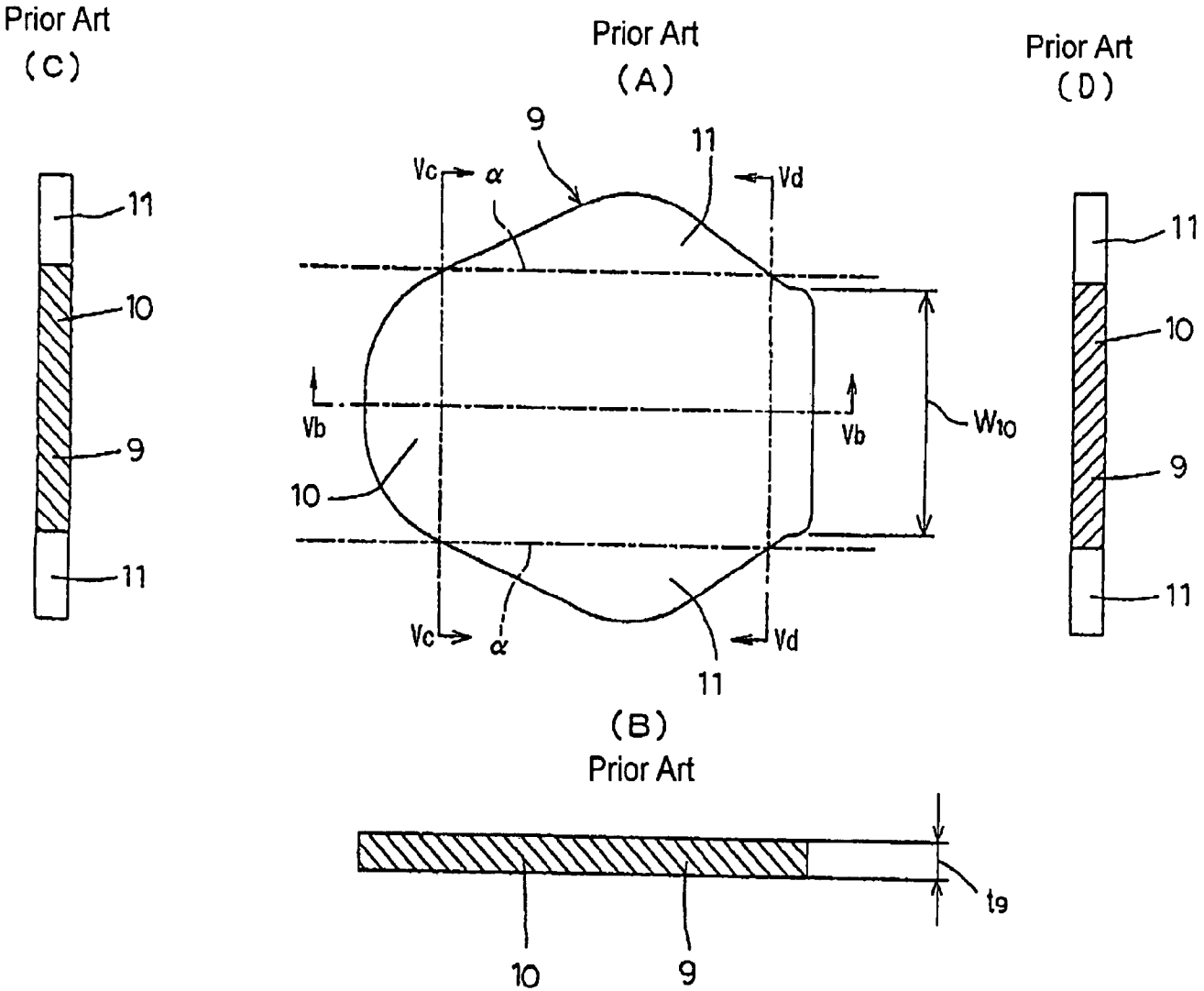
Prior Art Fig. 5
Figure 6:
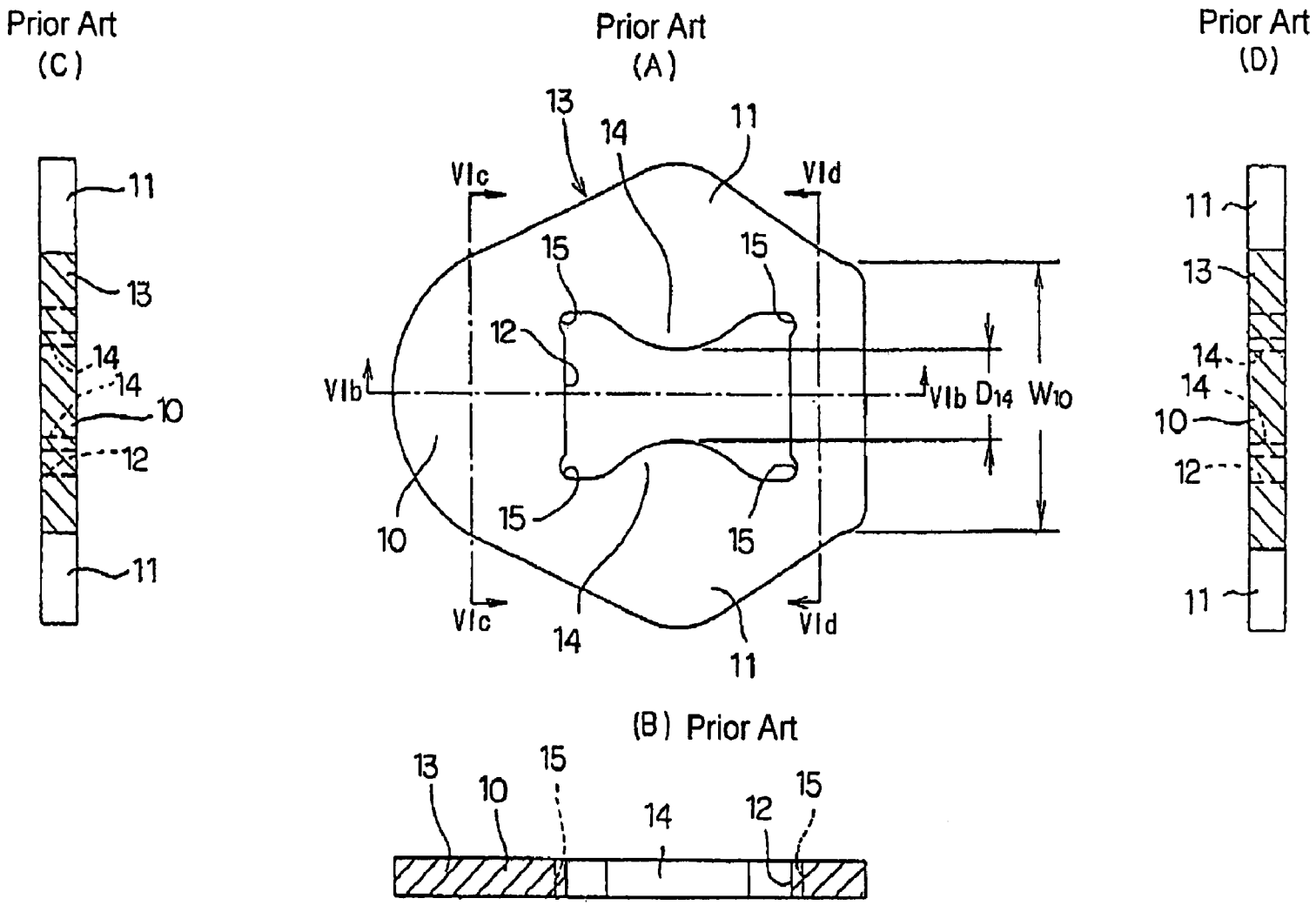
FIG. 6 Prior Art
Figure 7:
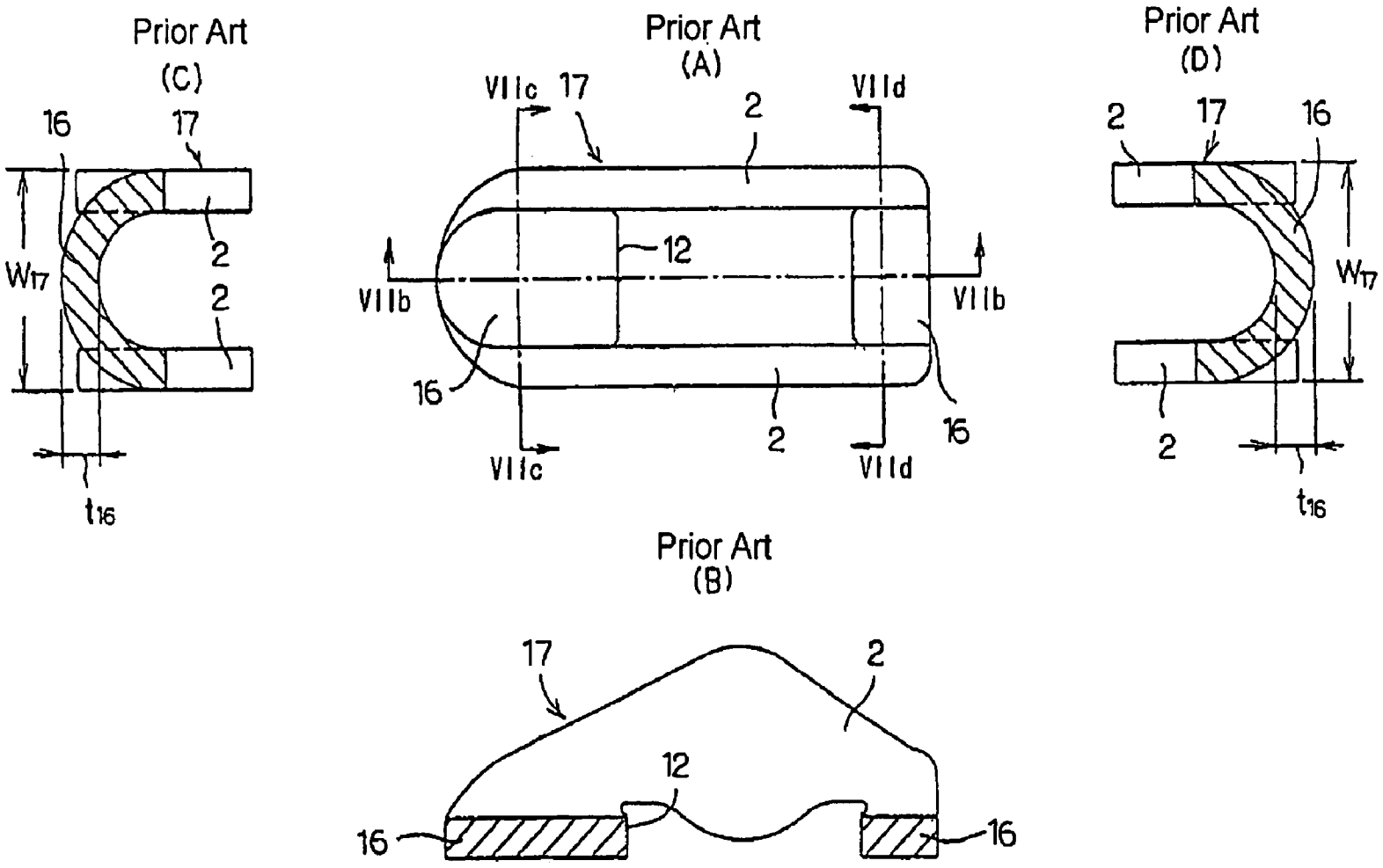
Fig. 7 Prior Art
Figure 8:
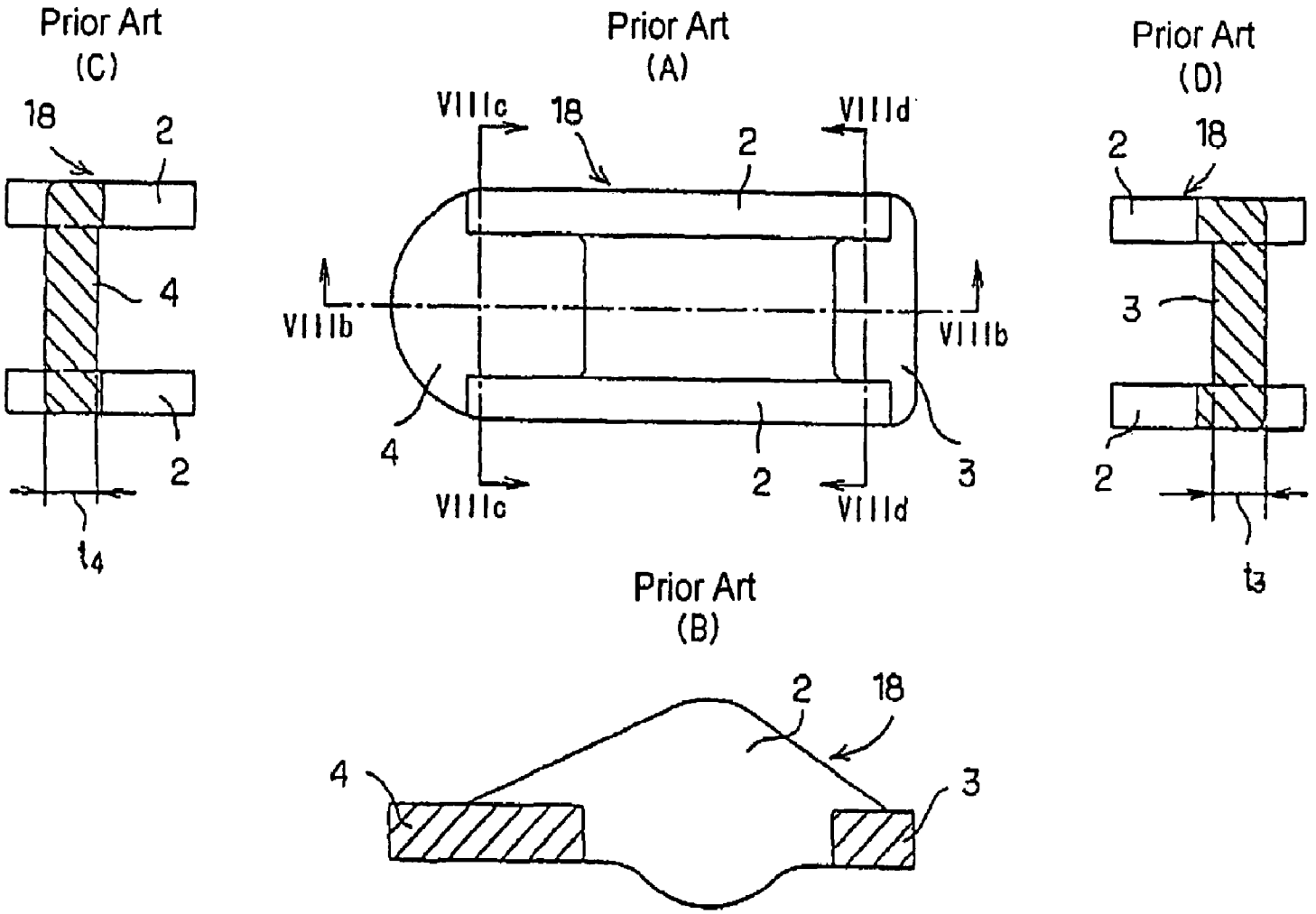
Fig. 8 Prior Art
Figure 9:
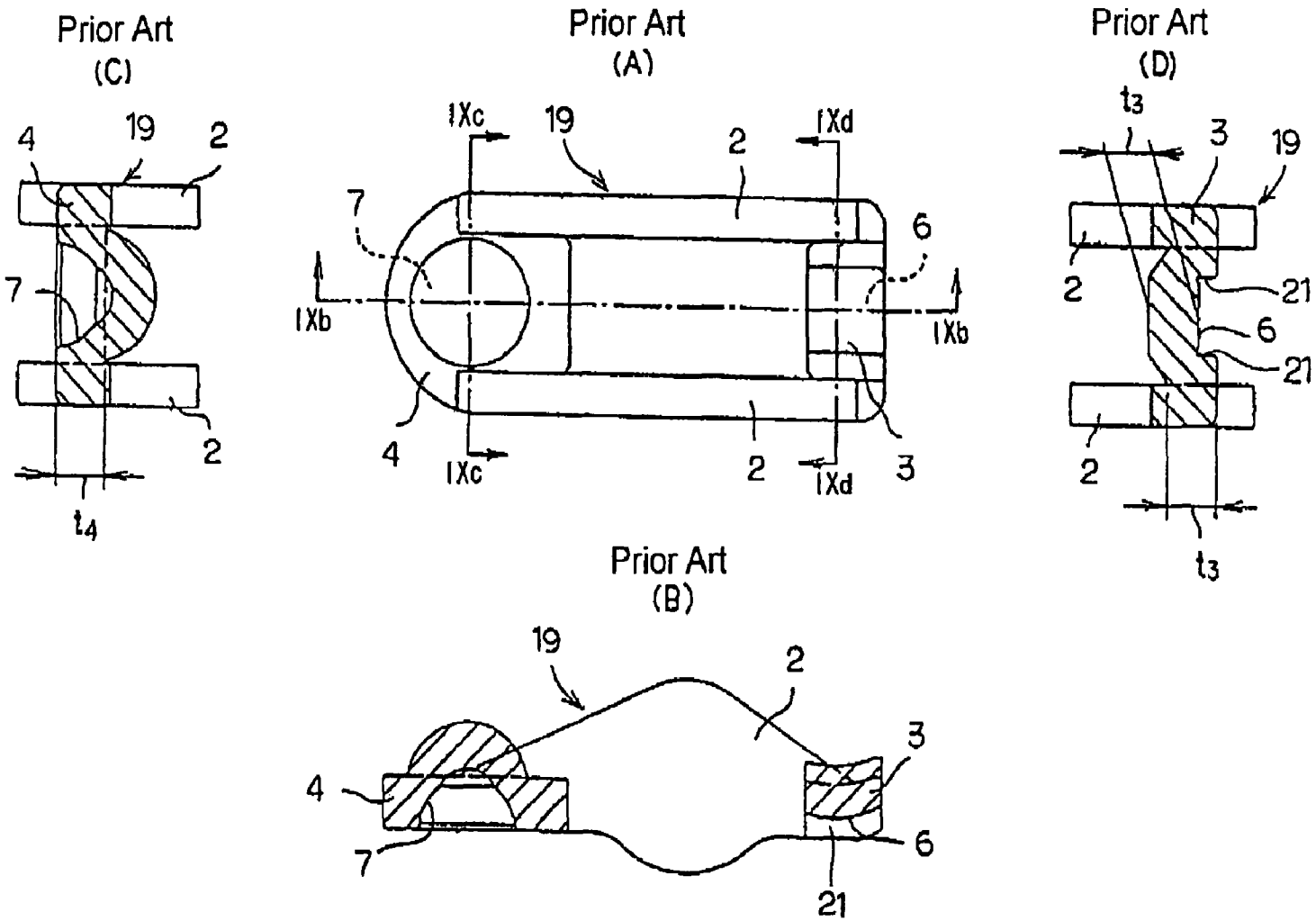
Prior Art Fig. 9
Figure 10:
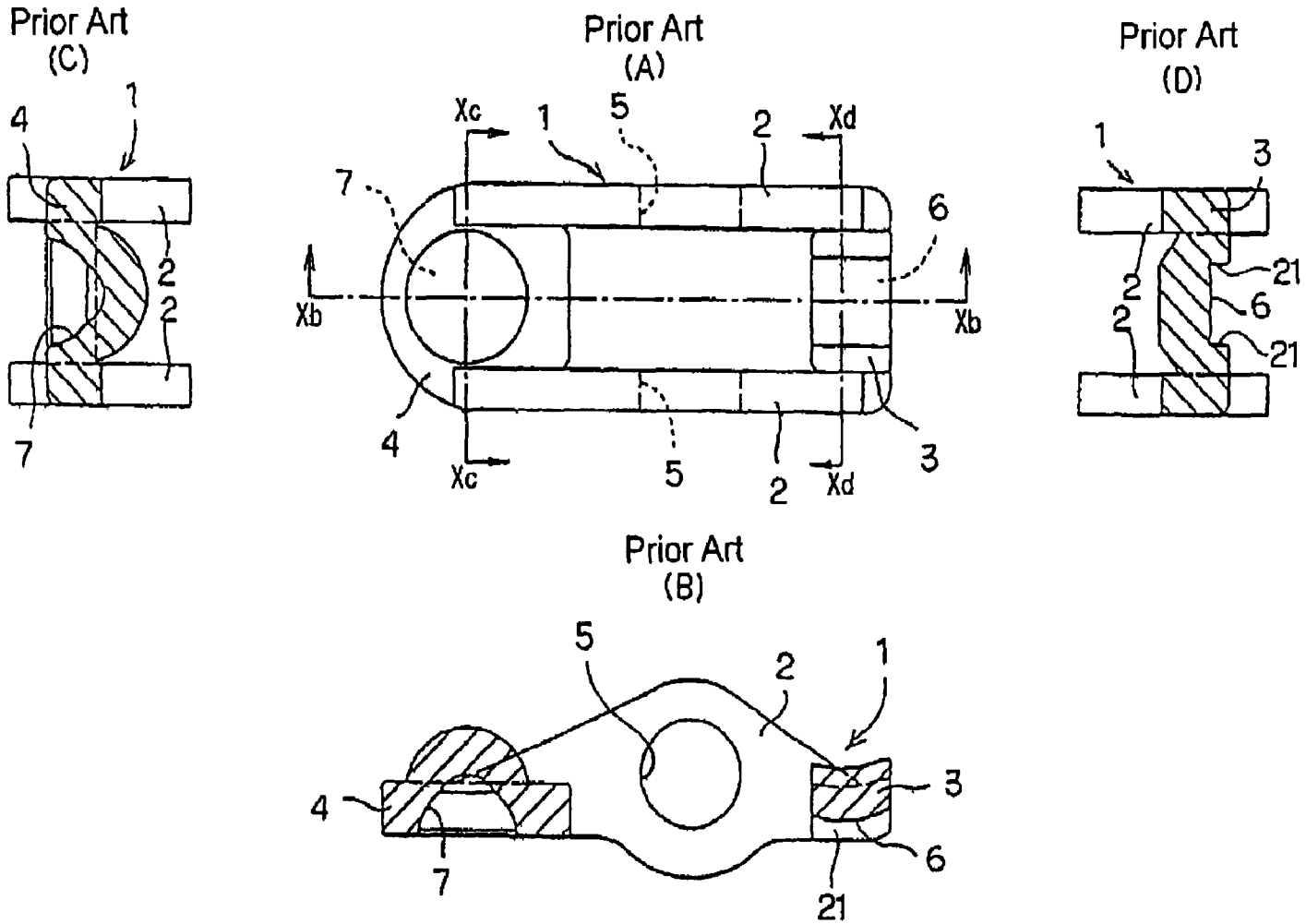
Prior Art Fig. 10

A feature of this embodiment is the reduction of the friction loss in the engagement sections between the rocker arm 1 and the valve stem 20 by designing, in shape, a pair of guide surfaces 21 that are located on both ends in the width direction of one surface of the connecting section 3 of the rocker arm 1 such that they are located on both sides in the width direction of the fitting surface 6. The construction of other parts of the rocker arm 1 are substantially the same as those of the prior art construction shown in FIG. 4 and FIG. 10 described above, so any redundant explanation is omitted or simplified, and only the features of this invention are explained below based on the drawings. The same reference numbers are used for identical parts.

Figure 1:
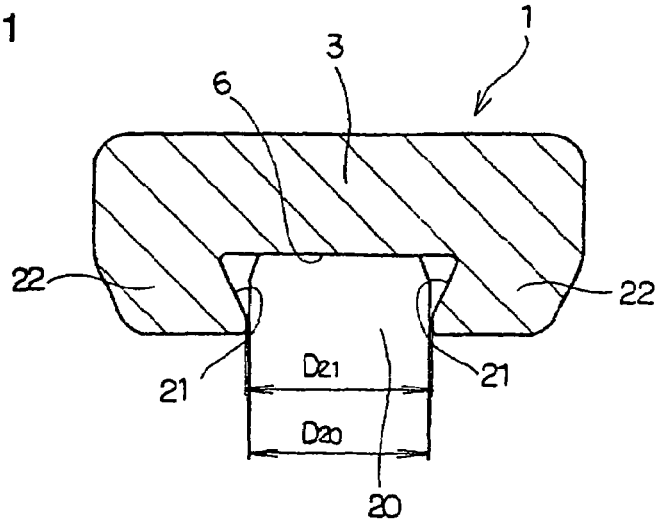
FIG. 1 is a cross sectional view to show a first example of the embodiment of the present invention corresponding to the enlarged cross section taken along the line I—I in FIG. 4.

FIG. 1 is a drawing showing a first example of the embodiment of the invention. In the case of the rocker arm 1 of this example, both of the guide surfaces 21 are inclined in a direction toward each other going away from the fitting surface 6. The space $D_{21}$ between the tip ends of these guide surfaces 21 (where the space is the narrowest) is slightly greater than the outer diameter $D_{20}$ of the base end section of the valve stem 20 ($D_{21}>D_{20}$). Also, the outer peripheral surface of the base end section of the valve stem 20 does not come in contact with either of the guide surfaces 21, or if it does come in contact, it comes in contact with the tip end edge of only one of the guide surfaces 21. There is no contact between the outer peripheral surface of the base end section of the valve stem 20 and the base sections or middle sections (the sections except for the tip end edge) of the guide surfaces 21. These guide surfaces 21 are formed by using a pressing process to bend the up-right sections 22, which are formed on both sides in the width direction of the connecting section 3 on part of the metal plate of the rocker arm 1, in a direction such that the space between the tip ends becomes smaller.

In the case of the rocker arm of this invention described above, even when the base end section of the valve stem 20 moves in the width direction (left and right direction in FIG. 1) of the fitting surface 6 and the outer peripheral surface of this base end section comes in contact with one of the guide surfaces 21, the area of the contact point between these surfaces is narrow, or in other words, the length of the contact point is short in the axial direction of the valve stem 20. Therefore, even when both the valve stem 20 and rocker arm 1 rock and move together, it is possible to keep the friction force acting on the point of contact between these surfaces small. In other words, since the length of the point of contact in the axial direction of the valve stem 20 is short, it is possible to improve the lubricity of the contact point and to keep the friction force per unit area small. Also, it is possible to keep small the moment of the friction resistance that acts at the point of contact. In other words, in the case of the prior art construction, the length of the contact point in the axial direction of the valve stem 20 was long, so when friction occurred between the surfaces acting in the direction of rocking movement of the contact point, the moment (resistance) due to this friction at the contact point became large. However, in the case of the construction of this example, the length in the axial direction of the valve stem 20 is very short. Therefore, it is possible to keep the moment due to the friction at this contact point very small. As a result, it is possible to keep small the resistance occurring at the fit between the rocker arm 1 and valve stem 20, and thus becomes easy to improve the engine performance.

Figure 2:
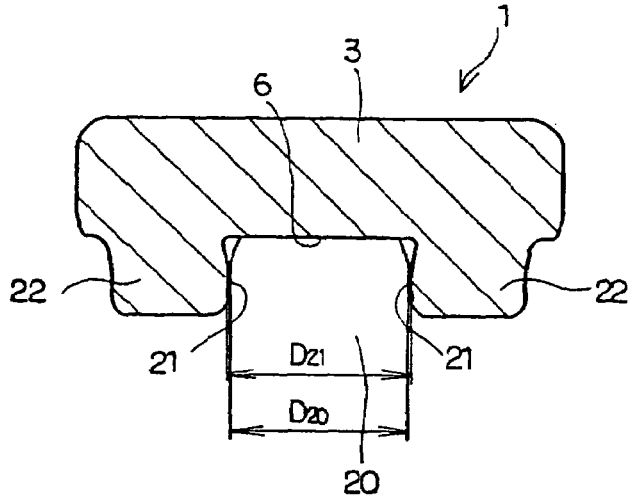
FIG. 2 is a view similar to FIG. 1 to show a second example.

Next, FIG. 2 shows a second example of the embodiment of the invention. In the first example, the pair of guide surfaces 21 was formed in a straight line shape in cross section, however in this example, the pair of guide surfaces is formed in a convex arc shape in cross sections. In the case of this example as well, the space $D_{21}$ between the tip end sections of the guide surfaces 21 (where the space is the narrowest) is slightly greater than the outer diameter $D_{20}$ of the base end section of the valve stem 20 ($D_{21}>D_{20}$). These guide surfaces 21 are also formed by a pressing process to bend the pair of bent upright sections 22, which are formed on both sides in the width direction of the connecting section 3 of part of the metal plate of the rocker arm 1, in a direction such that the space between the tip ends becomes small.

The other construction and function is substantially the same as that of the first example, so any redundant explanation is omitted.

Figure 3:
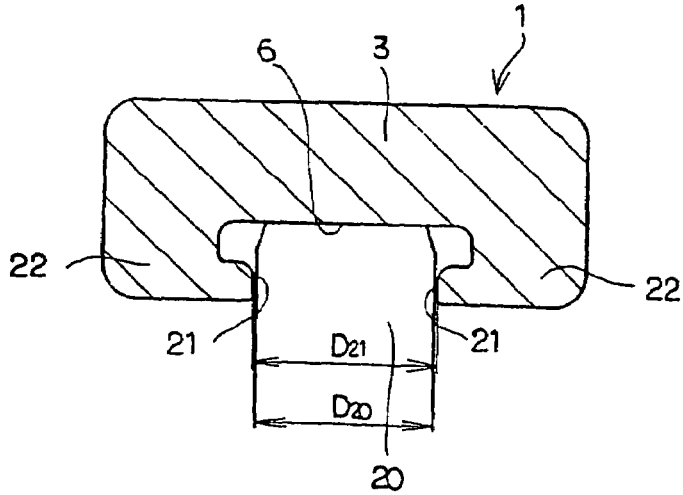
FIG. 3 is a view similar to FIG. 1 to show a third example.

Next, FIG. 3 shows a third example of the embodiment of the invention. In this example, the pair of guide surfaces 21 is formed in a crank shape in cross section. In the case of this example as well, the space $D_{21}$ between the tip end sections of the guide surfaces 21 (where the space is the narrowest) is slightly greater than the outer diameter of the base end section of the valve stem 20 ($D_{21}>D_{20}$). These guide surfaces 21 are also formed by a drawing process to bend the pair of bent upright sections 22, which are formed on both sides in the width direction of the connecting section 3 of part of the metal plate of the rocker arm 1, in a direction such that the space between the tip ends becomes small.

The other construction and function is substantially the same as that of the first embodiment, so any redundant explanation is omitted.

In the case of the rocker arm that is constructed and functions as described above, it is possible to keep the friction at the fit between the rocker arm and valve small, and to increase the performance of the engine in which this rocker arm is installed.

Figure 11:
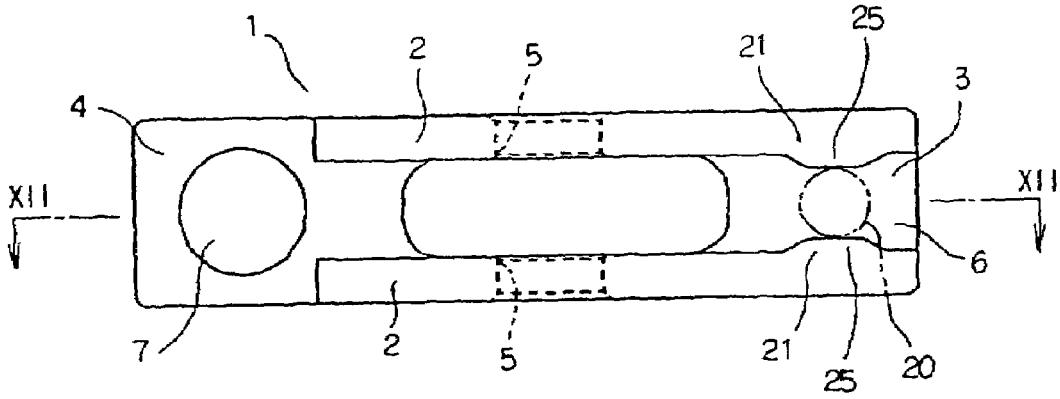
FIG. 11 is a bottom plan view of an example of the embodiment of the present invention.
Figure 12:
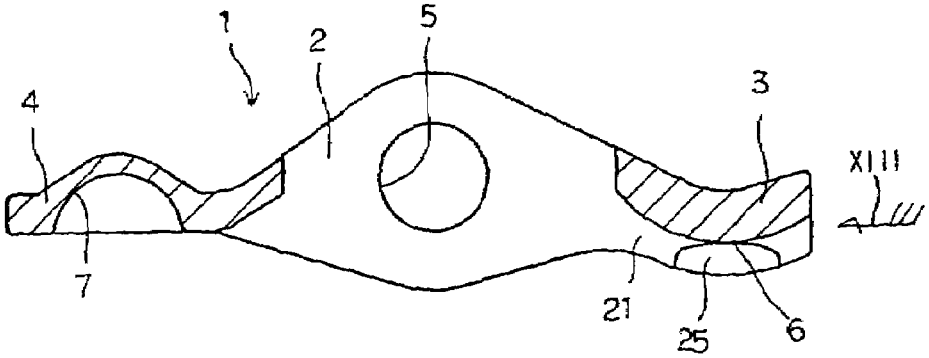
FIG. 12 is a cross sectional view taken along the line XII—XII in FIG. 11.
Figure 13:
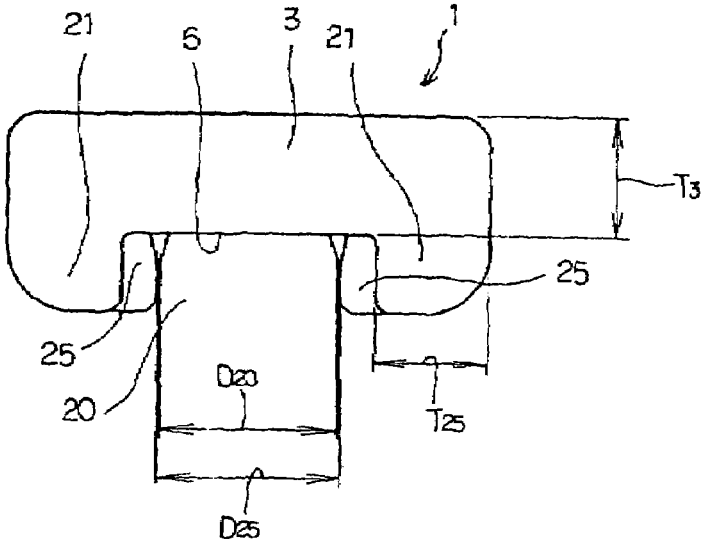
FIG. 13 is an enlarged view taken in the direction of Arrow III in FIG. 12.

FIGS. 11 to 13 show a fourth example of the embodiment of the invention. A feature of this example is to prevent large tensile stress, which causes damage such as cracking, from being applied to and near a pair of guide-wall sections 21, and to make a suitable fit between the rocker arm 1 and valve stem 20 by tailoring the shape of this pair of guide-wall sections 21 that are formed on both ends in the width direction of one surface of the connecting section 3 of the rocker arm 1 such that they are located on both sides in the width direction of the fitting surface 6. The construction of the other parts of the rocker arm 1 is substantially the same as that of the prior art construction shown in FIGS. 4 and 10 described above, so any redundant explanation will be omitted or simplified.

In the case of the rocker arm 1 of this example, the pair of guide-wall sections 21 are continuous from the pair of side-wall sections 2 on both sides of the connecting section 3 such that they face each other, and protrusion 25 are formed in the sections in the middle part in the lengthwise direction (left and right direction in FIGS. 11 and 12) of the guide-wall sections 21. These protrusions 25 are formed by swaging the metal plate before or after bending the metal blank plate of the rocker arm 1 to form the guide-wall sections 21. In order to do this, for example, the thickness $T_{25}$ of the guide-wall sections 21 in the sections away from the protrusions 25 are made to be less than the thickness $T_3$ of the connecting section 3 ($T_{25}<T_3$). Then, with a swaging process, these protrusions 25 are formed by gathering the material in the skin layer of the sections away from the protrusions 25 to the area of the protrusions 25.

In either case, the space $D_{25}$ between the peaks of these protrusions 25 is slightly greater than the outer diameter $D_{20}$ of the base end section of the valve stem 20 that comes in contact with the connecting section 3 ($D_{25}>D_{20}$). Therefore, when assembled in the engine, by bringing the base end section of the valve stem 20 in contact between the protrusions 25 in the middle section in the lengthwise direction of the connecting section 3, it is possible for the base end section of the valve stem 20 to fit with the connecting section 3 such that it can rock and move freely and such that it is possible to keep it from moving to the sides in the width direction of the connecting section 3 (up and down direction in FIG. 11, front and back direction in FIG. 12 and left and right direction in FIG. 13).

This work of forming protrusions 25 in order to regulate the inner dimension in width direction of the fitting section with the valve stem 20 can be performed mainly by swaging the metal plate to cause residual compression stress to occur. As is well known, the residual compression stress is not related to damage such as cracking, but functions to suppress the occurrence of damage such as cracking. Therefore, by processing the protrusions 25, it is possible to prevent damage such as cracking from occurring in and near these protrusions 25.

Figure 14:
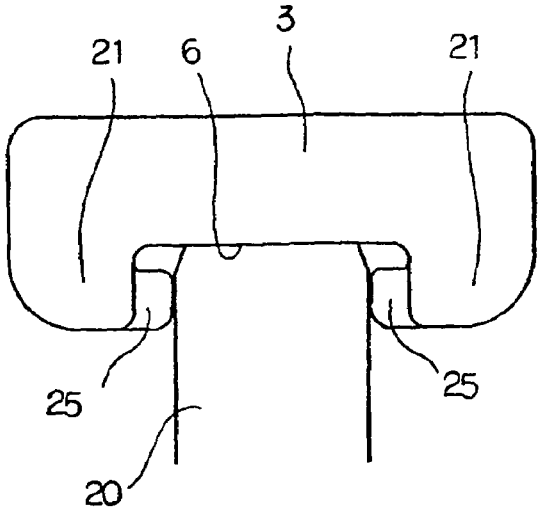
FIG. 14 is a bottom plan view of a fifth example of the embodiment of the present invention.

Next, FIG. 14 is used to show a fifth example of the embodiment of the invention. In the case of the first example described above, the protrusions 25 were formed nearly along the entire height of the guide-wall sections 21, however, in this example, the protrusions 25 are formed only from the middle to the tip end in the height direction of the inner surface of the guide-wall sections 21 (bottom half in FIG. 14). In other words, in this example, no protrusions are formed at the base end in the height direction of the guide-wall sections 21 (top end in FIG. 14). The protrusions 25 of this example as well, constructed as described above, are formed by the swaging process such that large tensile stress does not occur, and they make it possible to regulate the position of the valve stem 20 in the width direction of the connecting section 3. In this example, the protrusions 25 can also be made using a bending process.

The other construction and functions are substantially the same as those of the first example described above, so any redundant explanation is omitted.

Figure 15:
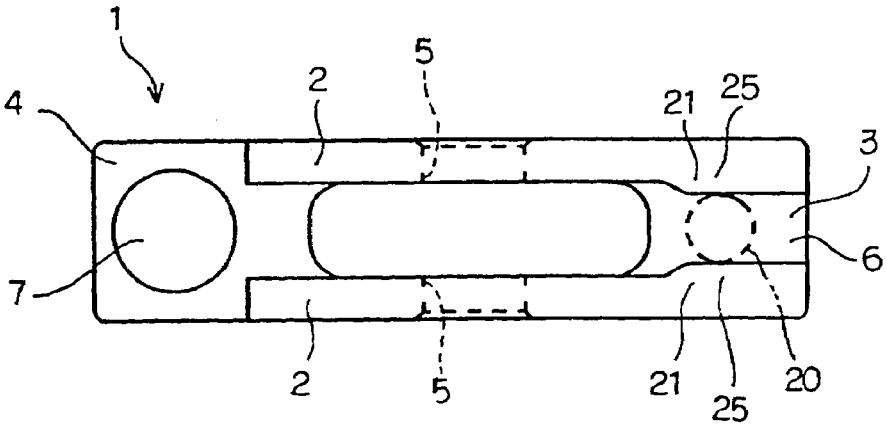
FIG. 15 is a bottom plan view of a sixth example of the embodiment of the present invention.

Next, FIG. 15 shows a sixth example of the embodiment of the invention. In the case of the first example, protrusions 25 were formed only in the middle in the lengthwise direction of the guide-wall sections 21, however, in this example, the protrusions 25 are formed from the middle to the end of the rocker arm 1. The protrusions 25 of this example as well, constructed as described above, are formed by the swaging process such that no large tensile stress occurs, and they make it possible to regulate the position of the valve stem 20 in the width direction of the connecting section 3.

The other construction and functions are substantially the same as those of the first example described above, so any redundant explanation is omitted.

Figure 16:
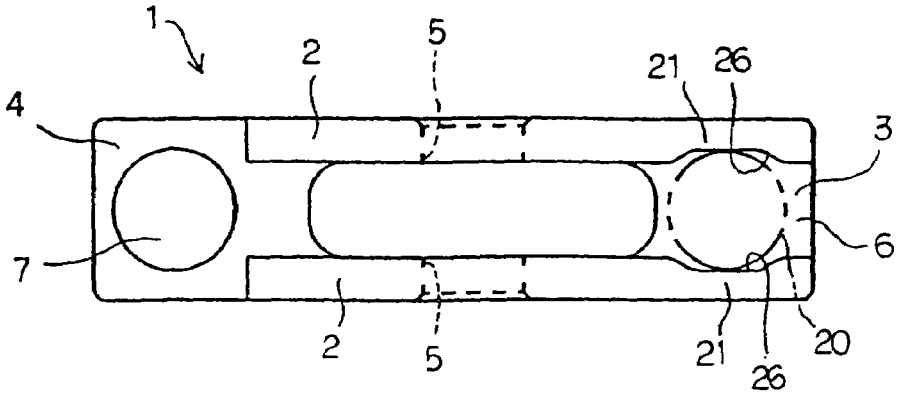
FIG. 16 is a bottom plan view of a seventh example of the embodiment of the present invention.

Next, FIG. 16 shows a seventh example of the embodiment of the invention. In the fourth thru the sixth examples, the space between the inside surfaces of the guide-wall sections 21 was made more narrow by forming protrusions 25 on part of the inside surface of the both of the guide-wall sections 21 in the section that holds the base end section of the valve stem 20. However, in this example, the space between the inside surfaces of the guide-wall sections 21 is made wide in the section that holds the base end section of the valve stem 20 by forming concave sections 26 in the section of the guide-wall sections 21 that holds the base end section of the valve stem 20.

The concave sections 26 of this example as well, are made by swaging the metal plate such that no large tensile stress occurs. The construction of this example, can be properly applied when the outer diameter of the base end section of the valve stem 20 abutted to the connecting section 3 is large, and make it possible to regulate the position of the valve stem 20 in the width direction of the connecting section 3. The concave sections 26 of this example can also be made by mechanical processing such as cutting.

Figure 17:
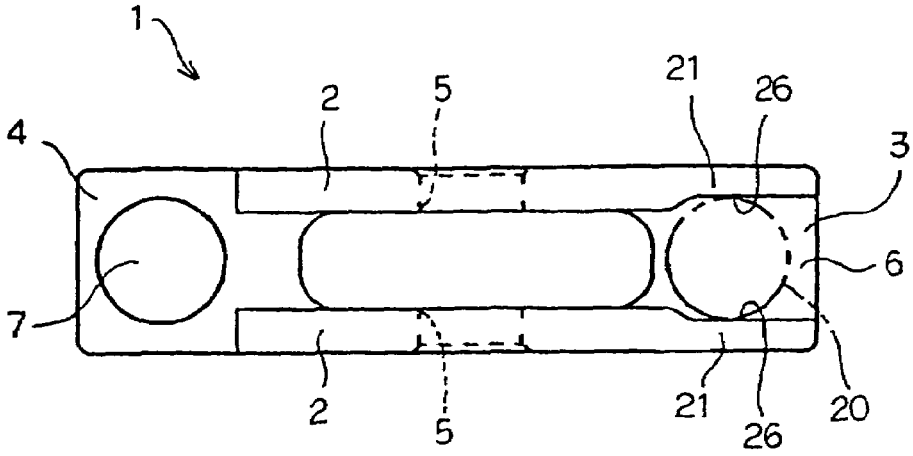
FIG. 17 is a bottom plan view of an eighth example of the embodiment of the present invention.
Figure 18:
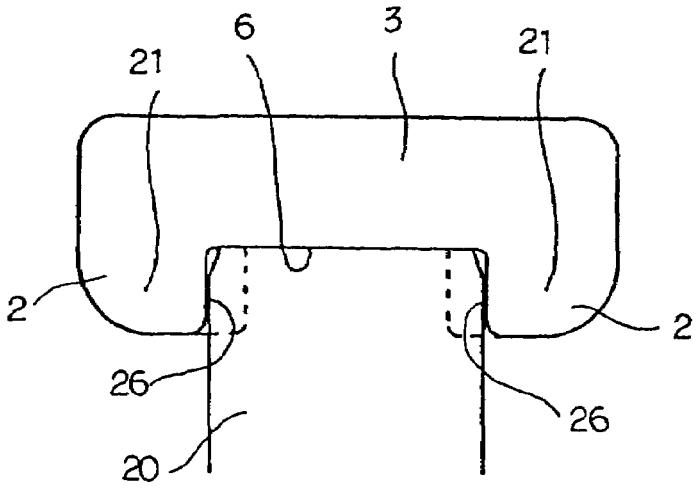
FIG. 18 is an enlarged view taken from the right side in FIG. 17.
Figure 19:
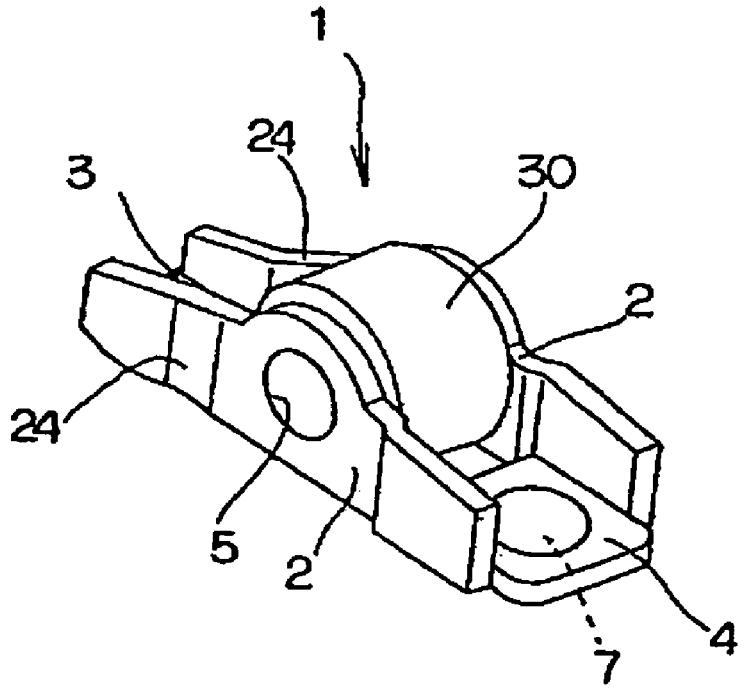
Prior Art Fig. 19
FIG. 19 is a perspective view to show an example of the conventional structure where the width of the connecting section is changed in size.
Figure 20:
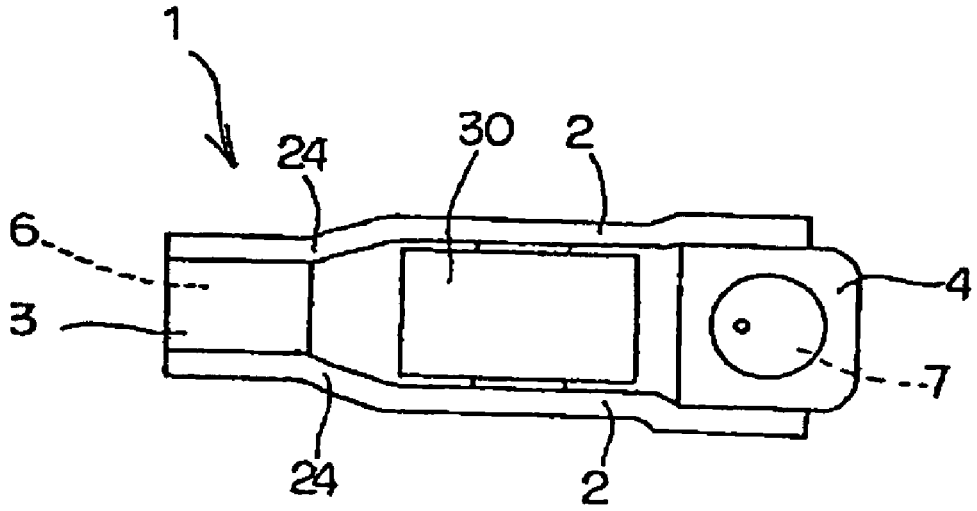
Prior Art Fig. 20
FIG. 20 is a top plan view of the conventional example in FIG. 19.

Next, FIGS. 17 and 18 show the eighth example of the embodiment of the invention. In the case of the seventh example described above, the concave sections 26 were formed only in the middle section in the lengthwise direction of the guide-wall sections 21. However, in this example, the concave sections 26 are formed from the middle section to the end of the rocker arm 1. The concave sections 26 of this example as well are made by the swaging process such that no large tensile stress occurs, and they can regulate the position of the valve stem 20 in the width direction of the connecting section 3.

The other construction and functions are substantially the same as those of the seventh embodiment described above, so any redundant explanation is omitted.

INDUSTRIAL APPLICABILITY

With the rocker arm that is constructed and functions as described above can be manufactured at low cost by performing plastic working such as pressing or punching of a metal plate, and it is possible to obtain a rocker arm that has a good fit with the base end section of the valve, and which also has excellent reliability and durability.

What is claimed is:

1. A rocker arm comprising a pair of side-wall sections separated from each other by a space, and a connecting section connecting the side-wall sections to each other in a widthwise direction of the rocker arm, the connecting section having a fitting surface on one surface thereof and with which an end face of a valve stem comes in contact, a pair of guide surfaces being provided to opposite sides of the fitting surface to prevent the valve stem from being displaced in the widthwise direction, the rocker arm being characterized in that the guide surfaces are non-parallel to each other with reference to a center axis of the valve stem, and a space between the guide surfaces is more narrow at a portion further from the fitting surface than at a portion nearer to the fitting surface, whereby a friction area between the guide surfaces and the valve stem is kept small, and wherein the guide surfaces are inclined such that the guide surfaces come closer to each other as they extend away from the fitting surface.

2. A rocker arm comprising a pair of side-wall sections separated from each other by a space, and a connecting section connecting the side-wall sections to each other in a widthwise direction of the rocker arm, the connecting section having a fitting surface on one surface thereof and with which an end face of a valve stem comes in contact, a pair of guide surfaces being provided to opposite sides of the fitting surface to prevent the valve stem from being displaced in the widthwise direction, the rocker arm being characterized in that the guide surfaces are non-parallel to each other with reference to a center axis of the valve stem, and a space between the guide surfaces is more narrow at a portion further from the fitting surface than at a portion nearer to the fitting surface, whereby a friction area between the guide surfaces and the valve stem is kept small, and wherein the guide surfaces are formed in a convex arc-shape in cross section.

3. A rocker arm comprising a pair of side-wall sections formed by plastically processing a metal plate such that the side-wall sections are separated from each other by a space, and a connecting section connecting the side-wall sections to each other in a widthwise direction of the rocker arm, the connecting section having a fitting surface on one surface thereof and with which an end face of a valve stem comes in contact a pair of guide-wall sections being provided to opposite sides of the fitting surface to prevent the valve stem from being displaced in the widthwise direction, the rocker arm being characterized in that outside surfaces of the guide-wall sections and outside surfaces of the side-wall sections are continuous with each other and located in a single plane, the guide-wall sections have guide portions located to guide opposite side portions of the valve stem, said guide portions being different in thickness than at least parts of other portions of the guide-wall sections, so that a space between inside surfaces of the guide portions substantially corresponds to an outer diameter of the valve stem.

4. The rocker arm of claim 3, wherein the thickness of the guide-wall sections is changed by swaging the metal plate to provide protrusions facing each other.

5. The rocker arm of claim 4, wherein the protrusions are formed only a tip portion and middle portion in a height direction of the inside surfaces of the guide-wall sections.

6. The rocker arm of claim 4, wherein the protrusions are formed from a middle portion in a lengthwise direction of the guide-wall sections to an end of the rocker arm.

7. The rocker arm of claim 3, wherein the thickness of the guide-wall sections is changed by swaging the metal plate to form concave portions.

8. The rocker arm of claim 7, wherein the concave portions are formed from a middle portion in a lengthwise direction of the guide-wall sections to an end of the rocker arm.

* * * * *